US006730632B2

(12) United States Patent
Watanabe et al.

(10) Patent No.: US 6,730,632 B2
(45) Date of Patent: May 4, 2004

(54) HEAT-SENSITIVE RECORDING MATERIAL

(75) Inventors: Tsutomu Watanabe, Shizuoka-ken (JP); Masayuki Iwasaki, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/443,876

(22) Filed: May 23, 2003

(65) Prior Publication Data

US 2003/0224935 A1 Dec. 4, 2003

(30) Foreign Application Priority Data

May 24, 2002 (JP) ..... 2002-150859

(51) Int. Cl.[7] ..... B41M 5/30
(52) U.S. Cl. ..... 503/216; 503/200
(58) Field of Search ..... 503/216, 200

(56) References Cited

U.S. PATENT DOCUMENTS 6,642,175 B2 * 11/2003 Mitsuo et al. ..... 503/209

FOREIGN PATENT DOCUMENTS

| | | | |
|---|---|---|---|
| EP | 1 116 713 A1 | | 7/2001 |
| JP | 2003025734 | * | 1/2003 |

OTHER PUBLICATIONS

Japanese Abstract No. 11342676, dated Dec. 14, 1999.

* cited by examiner

*Primary Examiner*—N. O. Edwards
(74) *Attorney, Agent, or Firm*—Sughrue Mion, PLLC

(57) ABSTRACT

A heat-sensitive recording material which includes, on a substrate, at least one heat-sensitive color developing layer containing an electron-donating colorless dye, 2,4-bis (phenylsulfonyl)phenol as an electron-accepting compound, and a sulfonic acid-modified polyvinyl alcohol and at least one modified polyvinyl alcohol other than the sulfonic acid-modified polyvinyl alcohol as binders, an outermost layer of the heat-sensitive recording material containing a lubricant.

20 Claims, No Drawings

HEAT-SENSITIVE RECORDING MATERIAL

BACKGROUND OF THE INVENTION

1. Field of the Invention

The present invention relates to a heat-sensitive recording material, specifically, a heat-sensitive recording material giving a high color development density and having excellent storage stability.

2. Description of the Related Art

In recent years, heat-sensitive recording materials, onto which heat is supplied from a thermal head or the like so as to record images, have been spreading since the materials are relatively inexpensive and recording device for the materials are simple and high in reliability and require no maintenance.

Under such a situation, in particular, improvement in performances thereof, for example, improvement in the image quality and storage stability thereof has been highly demanded in recent years. Thus, eager research on the color development density, the image quality, the storability and other properties of the heat-sensitive recording materials has been conducted.

As a heat-sensitive recording material having a high sensitivity, for example, Japanese Patent Application Laid-Open (JP-A) No. 11-342676 describes an example in which 2,4-bis(phenylsulfonyl)phenol is used as a color developing agent (electron-accepting compound). However, even the heat-sensitive recording material described in this publication cannot satisfy recently increasing market demands for high sensitization and the like. In particular, there is a room for improvement in the water resistance of heat-sensitive recording materials, and the sticking resistance thereof, which is concerned with fraction between the materials and a thermal head.

SUMMARY OF THE INVENTION

The inventors have found out that performances of a heat-sensitive recording material are improved by appropriately selecting the kind of an electron-accepting compound added to a heat-sensitive color developing layer, selecting a binder incorporated, together with an electron-donating colorless dye and the electron-accepting compound, added to the heat-sensitive color developing layer, and selecting an appropriate additive added to an outermost layer.

An object of the invention is to provide a heat-sensitive recording material which has a high sensitivity, gives a high print density, is superior in storage stabilities (heat resistance, humidity resistance and plasticizer resistance (solvent resistance)) of image portions and non-image portions (background portions) and head break resistance, and is particularly superior in water resistance, stamping ability and sticking resistance.

Some embodiments of the present invention for solving the above-mentioned problems are shown as follows:

A first aspect of the invention provides a heat-sensitive recording material which comprises, on a substrate, at least one heat-sensitive color developing layer comprising an electron-donating colorless dye, 2,4-bis(phenylsulfonyl) phenol as an electron-accepting compound, and a sulfonic acid-modified polyvinyl alcohol and at least one modified polyvinyl alcohol other than the sulfonic acid-modified polyvinyl alcohol as binders, an outermost layer of the heat-sensitive recording material comprising a lubricant.

A second aspect of the invention provides a heat-sensitive recording material according to the first aspect, wherein the heat-sensitive color developing layer comprises an acetoacetyl-modified polyvinyl alcohol as the modified polyvinyl alcohol other than the sulfonic acid-modified polyvinyl alcohol A third aspect of the invention provides a heat-sensitive recording material according to the first or second aspect, wherein the lubricant is an aliphatic acid metal salt, or an aliphatic acid amide compound having a melting point of 105° C. or more.

DETAILED DESCRIPTION OF THE INVENTION

The heat-sensitive recording material of the present invention is a heat-sensitive recording material which comprises, on a substrate, at least one heat-sensitive color developing layer comprising an electron-donating colorless dye, 2,4-bis(phenylsulfonyl)phenol as an electron-accepting compound, and a sulfonic acid-modified polyvinyl alcohol and at least one modified polyvinyl alcohol other than the sulfonic acid-modified polyvinyl alcohol as binders, an outermost layer of the heat-sensitive recording material comprising a lubricant.

In the heat-sensitive recording material of the invention, its heat-sensitive color developing layer comprises an electron-donating colorless dye, 2,4-bis(phenylsulfonyl) phenol as an electron-accepting compound, a sulfonic acid-modified polyvinyl alcohol, which may be referred to as a "sulfonic acid-modified PVA" hereinafter, and at least one modified polyvinyl alcohol other than the sulfonic acid-modified polyvinyl alcohol, which may be referred to as a "different modified PVA" hereinafter, and further an outermost layer of the heat-sensitive recording material comprises a lubricant, thereby making it possible to improve various performances of the heat-sensitive recording layer, for example, sensitivity, print density, storage stability (heat resistance, humidity resistance and plasticizer resistance (solvent resistance)) of image portions and non-image portions (background portions) and head break resistance, and further improve the water resistance of the heat-sensitive recording material, the stamping ability thereof, and the sticking resistance thereof, which is related to fraction between the material and a thermal head.

The "outermost layer" of the heat-sensitive recording material, which comprises the lubricant in the invention, means a layer disposed as the outermost layer on the recording side in the heat-sensitive recording material. This layer is brought into direct contact with a thermal head when images are printed by the thermal head. For example, when only the heat-sensitive color developing layer is formed on the substrate, the heat-sensitive color developing layer is the outermost layer. When a protective layer is formed on the heat-sensitive color developing layer, the protective layer is the outermost layer. The "sticking resistance" means performance against defects, such as noises (adhesion sounds) at the time of printing images, and white spots, in which a part of a printed image is missing, the defects resulting from fraction between the thermal head and the surface of the heat-sensitive recording material.

The following will describe the heat-sensitive recording material of the invention in detail.

The heat-sensitive recording material of the invention comprises at least one heat-sensitive color developing layer on or over a substrate. A plurality of the layers may be disposed; some other layer such as an undercoat layer or a protective layer may be formed when necessary.

Heat-Sensitive Color Developing Layer

The heat-sensitive color developing layer comprises an electron-donating colorless dye, 2,4-bis(phenylsulfonyl) phenol as an electron-accepting compound, and a sulfonic acid-modified PVA and at least one different modified PVA as binders. If necessary, this layer comprises some other component such as a heat-melting material or an image stabilizer.

Electron Acceptable Compound

In the heat-sensitive recording material of the invention, 2,4-bis(phenylsulfonyl)phenol is used as an electron-accepting compound which makes an electron-donating colorless dye exhibit color. The electron-donating colorless dye will be described later in detail. By the use of 2,4-bis (phenylsulfonyl)phenol as the electron-accepting compound, the heat-sensitive recording material has superior storage stability.

In order to improve the sensitivity and give a high color development density, 2,4-bis(phenylsulfonyl)phenol is dispersed in the binder, which comprises the sulfonic acid-modified PVA and the different modified PVA, in the heat-sensitive color developing layer so as to have preferably a volume-average particle size of 0.4 to 1.0 μm, and more preferably 0.4 to 0.8 μm. If the volume-average particle size is less than 0.4 μm, the fog density of background portions in the resultant printed material may rise during storage. If the size is more than 1.0 μm, the heat-sensitivity may decrease. It is hard to produce particles having a volume-average particle size of less than 0.3 μm.

The volume-average particle size can easily be measured by means of a laser diffraction type particle size distribution measuring apparatus (for example, LA500 (manufactured by Horiba Ltd.)).

Examples of the method of dispersing the 2,4-bis (phenylsulfonyl)phenol particles include a method using a ball mill, a method using a rod mill, a method using an attriter, and a method using a sand grinder. In light of an increase in the demand of heat-sensitive recording materials in recent years, the method using a sand grinder is preferably used from the viewpoint of practical production efficiency.

In the dispersion using a sand grinder, it is preferred to use, as dispersing beads, glass beads, ceramic beads or steel beads having a diameter of 0.2 to 10 mmϕ.

In the invention, any other known electron-accepting compound may be used together with 2,4-bis (phenylsulfonyl)phenol as long as the advantageous effects of the invention are maintained.

The known electron-accepting compound can be appropriately selected in accordance with the purpose of the resultant heat-sensitive recording material, or the like. From the viewpoint of suppressing background fog, a phenolic compound, or a salicylic acid derivative or a polyvalent metal salt thereof is preferred.

Examples of the phenolic compound include 2,2'-bis(4-hydroxyphenol)propane(bisphenol A), 2,4-bis(2,5-dimethylphenylsulfonyl)phenol, 4-t-butylphenol, 4-phenylphenol, 4-hydroxydiphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcyclohexylidenephenol, 4,4'-isopentylidenephenol, benzyl p-hydroxybenzoate, and 4-hydroxy-4'-isopropyloxydiphenylsulfone.

Examples of the salicylic acid derivative include 4-pentadecylsalicylic acid, 3-5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid and 4-octadecyloxysalicylic acid, and zinc, aluminum, calcium, copper and lead salts thereof.

The above-mentioned electron-accepting compounds may be used alone or in combination of two or more thereof.

Since a particularly high color development density can be obtained, 2,4-bis(2,5-dimethylphenylsulfonyl)phenol is particularly preferred.

In the invention, the content of the electron-accepting compound (such as 2,4-bis(phenylsulfonyl)phenol) is preferably from 50 to 500% by mass, and more preferably from 100 to 300% by mass, based on the amount of the electron-donating colorless dye, which will be detailed later. If the volume-average particle size of 2,4-bis(phenylsulfonyl) phenol, which is an electron-accepting compound, is within the above-mentioned range, the above-mentioned content can be decreased.

Electron Donating Colorless Dye

The kind of the electron-donating colorless dye is not particularly limited, and can be appropriately selected from known electron-donating colorless dyes, for example, the following compounds. In the invention, however, the kind is not limited to these examples.

Examples of the electron-donating colorless dye which is developed into black color include 3-di(n-butylamino)-6-methyl-7-anilinofluorane, 2-anilino-3-methyl-6-N-ethyl-N-sec-butylaminofluorane, 3-di(n-pentylamino)-6-methyl-7-anilinofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethyoxypropyl)-N-ethylamino]-6-metyl-7-anilinofluorane, 3-di(n-butylamino)-7-(2-chloroanilino)fluorine, 3-diethylamino-7-(2-chloroanilino) fluorine, 3-diethylamino-6-methyl-7-anilinofluorane, and 3-(N-cyclohexyl-N-methylamino)-6-methyl-7-anilinofluorane.

Particularly preferred are 3-di(n-butylamino)-6-methyl-7-anilinofluorane, 2-anilino-3-methyl-6-N-ethyl-N-sec-butylaminofluorane since they are good in property about background fog in non-image portions.

Electron donating colorless dyes developed into red or purplish red, orange, blue, green and yellow colors can be appropriately selected from known compounds. These electron-donating colorless dyes may be used alone, or they may be used in combination of two or more thereof for modification of the color tone or other purposes.

The electron-donating colorless dye is contained in a coating solution for forming a heat-sensitive color developing layer, which may be referred to as a "heat-sensitive color developing layer coating solution" hereinafter. The coating solution may be prepared by dispersing the dye in a solvent as a solid dispersion, or by encapsulating the dye into microcapsules having heat responsibility and/or pressure responsibility.

Plural kinds of the above-mentioned electron-donating colorless dyes may be appropriately selected so as to be made into a multicolor-developable heat-sensitive recording material. Specifically, such a heat-sensitive recording material can be produced, for example, by incorporating electron-donating colorless dyes which can be developed into hues different from each other into different layers, respectively, so as to form a structure having two or more heat-sensitive color developing layers, or by encapsulating two or more kinds of electron-donating colorless dyes into different microcapsules, respectively, so as to form a heat-sensitive color developing layer.

The heat-sensitive color developing layer comprising the electron-donating colorless dye can formed, for example, by applying a coating solution for forming the heat-sensitive color developing layer onto a substrate. The content of the electron-donating colorless dye in the heat-sensitive color developing layer is preferably from 0.1 to 1.0 g/m$^2$. From the viewpoints of color development density and fog density of background portions, the content is more preferably from 0.2 to 0.5 g/m$^2$.

The method of encapsulating the color developing components into microcapsules can be appropriately selected from known methods. A preferred example is an interfacial polymerization method, which comprises the steps of mixing an oil phase prepared by dissolving or dispersing one of the color developing components (for example, an electron-donating colorless dye precursor) into a hydrophobic organic solvent, which will constitute the core of capsules, with a water phase in which a water-soluble polymer is dissolved, emulsifying or dispersing the two phases by means of a homogenizer or the like, and heating the emulsion to cause a polymer-forming reaction at the interface of oil droplets, thereby forming microcapsule walls of a polymer material. The interfacial polymerization method is preferred since it enables to form capsules having a uniform particle size in a short time and brings a heat-sensitive recording material superior in storability.

Binders

In the heat-sensitive recording material of the invention, a sulfonic acid-modified PVA and at least one different modified PVA (i.e., one or more different modified PVAs) are used as binders.

Since a sulfonic acid-modified PVA and at least one different modified PVA are used as binders in the invention, the water resistance of the heat-sensitive recording material can be improved. Furthermore, the dispersion stability of 2,4-bis(phenylsulfonyl)phenol can be improved.

It is sufficient that the heat-sensitive color developing layer in the invention comprises at least one selected from the different modified PVAs. Examples of the different modified PVA include acetoacetyl-modified polyvinyl alcohol, carboxy-modified polyvinyl alcohol, silicon-modified polyvinyl alcohol, amino-modified polyvinyl alcohol, and itaconic acid-modified polyvinyl alcohol. Acetoacetyl-modified alcohol is particularly preferred.

The amount of the sulfonic acid-modified PVA contained in the heat-sensitive color developing layer is preferably from 10 to 90 parts by mass, and more preferably from 30 to 90 parts by mass, per 100 parts by mass of the one or more different PVAs. If the content of the sulfonic acid-modified PVA per 100 parts by mass of the one or more different PVAs is within the above-mentioned range, the stability of the 2,4-bis(phenylsulfonyl)phenol-dispersion can be improved.

The coating amount of the binder (including the sulfonic acid-modified PVA and the different modified PVA) in the heat-sensitive color developing layer is preferably from 0.01 to 5 g/m$^2$, and more preferably from 0.1 to 3 g/m$^2$.

In the invention, an additional known water-soluble binder may be used together with the sulfonic acid-modified PVA and the different modified PVA as long as the advantageous effects of the invention are maintained.

The additional known water-soluble binder is preferably a compound having the solubility of at least 5% by mass in water at 25° C. Examples thereof include polyvinyl alcohols other than modified polyvinyl alcohols, methyl cellulose, carboxymethylcellulose, starches, which may be modified starches, gelatin, gum arabic, casein, and saponificated styrene-maleic anhydride copolymer.

The binders are used not only to disperse the color developing components but also to improve the film strength of the heat-sensitive color developing layer. In order to make the film stronger, the following synthetic polymer latex binder may be used together: styrene-butadiene copolymer, vinyl acetate copolymer, acrylonitrile-butadiene copolymer, methyl acrylate-butadiene copolymer or polyvinylidene chloride or the like.

Other Components

The heat-sensitive color developing layer may comprise other components such as a heat-meltable substance, a sensitizer and an image stabilizer.

Heat-Meltable Substance

As the heat-meltable substance, 2-naphthyl benzyl ether and amide compounds are preferred. Incorporation of the heat-meltable substance into the heat-sensitive color developing layer improves the storage stability of image portions (color-developed portions) and non-image portions (background portions).

The amide compound can be appropriately selected from known amide compounds. Examples thereof include palmitic acid amide, stearic acid amide, behenic acid amide, hydroxystearic acid amide, methylolstearic acid amide, methylobehenic acid amide, methylenebisstearic acid amide, ethylenebisstearic acid amide, ethylenebisstearic acid amide, and ethylenebisbehenic acid amide. Stearic acid amide, ethylenebisstearic acid amide, methylolstearic acid amide, and so on are particularly preferred.

In the case that 2-naphthyl benzyl ether and the amide compound are used together, the content of the amide compound is preferably from 2 to 100 parts by mass, and more preferably from 10 to 50 parts by mass, per 100 parts by mass of 2-naphthyl benzyl ether.

If the content of the amide compound is less than 2 parts by mass, a high density may not be obtained. If the content is more than 100 parts by mass, the fog density of background portions in the resultant printed material may rise (the storage stability of the background portions may be lowered) when the material is kept at a high temperature and a high humidity.

Other known heat-meltable substances may be used together. Examples thereof include stearyl urea, p-benzylbiphenyl, di(2-methylphenoxy)ethane, di(2-methoxyphenoxy)ethane, β-naphthol-(p-methylbenzyl) ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediolphenyl ether, diethylene glycol bis(4-methoxyphenyl) ether, methyl m-terphenyloxalate benzyl ether, 1,2-diphenoxymethylbenzene, 1,2-bis(3-methylphenoxy)ethane, and 1,4-bis(phenoxymethyl) benzene.

The total content of the heat-metable substances in the heat-sensitive color developing layer is preferably from 75 to 200 parts by mass, and more preferably from 100 to 150 parts by mass, per 100 parts by mass of the electron-accepting compound.

In the case that 2-naphthyl benzyl ether and the amide compound are used together with the known heat-meltable compound, the total amount of 2-naphthyl benzyl ether and the amide compound is preferably 50% or more, more preferably 70% or more by mass of the total amount of the heat-meltable substances.

Image Stabilizer

The image stabilizer can be appropriately selected from known compounds. Phenolic compounds are effective, and hindered phenolic compounds are particularly effective.

Examples thereof include 1,1,3-tris(2-methyl-4-hydroxy-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

The content of the image stabilizer is preferably from 10 to 100 parts by mass, and more preferably from 30 to 60 parts by mass, per 100 parts by mass of the electron-donating colorless dye. If the content is less than 10 parts by mass, desired effects concerning background fog and image storability may not be obtained. If the content is more than 100 parts by mass, sufficient advantageous effects may not be obtained.

The electron-donating colorless dye, the electron-accepting compound and the other components such as a sensitizer are dispersed simultaneously or separately by means of a stirring/pulverizing machine such as a ball mill, a rod mill, an attriter, or a sand grinder, so as to be prepared into a coating solution finally. In the case that they are separately dispersed, the dispersion is performed, preferably using any one of the sulfonic acid-modified PVA and the different modified PVA, more preferably using both of them. (When other components are dispersed, it is not necessary to use the sulfonic acid-modified PVA and the different modified PVA.) If necessary, to the coating solution may be added one or more selected from various surfactants, antistatic agents, ultraviolet ray absorbers, and antifoaming agents, fluorescent dyes, and so on.

Examples of the surfactants include alkali metal salts of sulfosuccinic acid, and fluorine-containing surfactants.

The respective components are dispersed and prepared into a coating solution as described above, and then the coating solution is applied onto a substrate by a known coating method. The applied solution is dried, subjected to smoothening treatment by a calendar, and becomes ready for use. The coating amount of the coating solution for forming a heat-sensitive color developing layer is not particularly limited when the layer is formed. Usually, the coating amount is preferably from about 2 to 7 g/m$^2$ as a dry mass.

The known coating method to be used is not particularly limited. Examples thereof include coating methods using an air knife coater, a roll coater, a blade coater, and a curtain coater. Particularly preferred is the method using a curtain coater.

Lubricant

The lubricant contained in the outermost layer of the heat-sensitive recording material of the invention may be a metal soap, a wax or the like.

Examples of the metal soap include aliphatic acid metal salts. Higher aliphatic acid metal salts are particularly preferred. Specific examples thereof include zinc stearate, calcium stearate and aluminum stearate.

Examples of the wax include paraffin wax, microcrystalline wax, carnauba wax, methylolstearoamide, polyethylene wax, polystyrene wax, and aliphatic acid amide compounds. They are used alone or in combination of two or more thereof.

The lubricant in the invention is preferably an aliphatic acid metal salt or an aliphatic acid amide compound in order to improve the sticking resistance and head break resistance. Aliphatic acid amide compounds having a melting point of 105° C. or more and aliphatic acid metal salts are more preferred. Examples of the aliphatic acid amide compounds having a melting point of 105° C. or more include ethylenebisstearic acid amide (melting point: 145° C.), methylolstearoamide (melting point: 110° C.), ethylenbisoleic acid amide (melting point: 116° C.) and N-stearyl-N'-stearylurea (melting point: 109° C.).

Substrate

The substrate may be a known substrate. Specific examples thereof include paper substrates such as a fine quality paper substrate; coated-paper substrates, in which paper is coated with resin or pigment; resin-laminated paper substrates; high quality paper substrates having an undercoat layer; regenerated paper substrates having an undercoat layer; synthetic paper substrates; and plastic film substrates.

The substrate is preferably a smooth substrate having a smoothness, defined in JIS-8119, of 300 seconds or more from the viewpoint of dot reproducibility.

When an undercoat layer is formed on the substrate as described above, the undercoat layer preferably includes a pigment as a main component thereof.

As the pigment, any one selected from all ordinary inorganic and organic pigments can be used. A pigment having an oil absorbency, defined in JIS-K5101, of 40 ml/100 g (cc/100 g) or more is particularly preferred. Specific examples thereof include calcium carbonate, barium sulfate, aluminum hydroxide, kaolin, sintered kaolin, amorphous silica, and urea formalin resin powder. Among these pigments, ones in which the above-mentioned oil absorbance is 70 ml/100 g or more are particularly preferred.

The coating amount of the pigment is preferably 2 g/m$^2$ or more, more preferably 4 g/m$^2$ or more, and most preferably 7 to 12 g/m$^2$.

Examples of a binder used in the undercoat layer include water-soluble polymers and water-soluble binders. These may be used alone or in combination of two or more thereof.

Examples of the water-soluble polymer include starch, polyvinyl alcohol, polyacrylamide, carboxymethyl alcohol, methylcellulose, and casein. In general, the water-soluble binder is, for example, a synthetic rubber latex, or a synthetic resin emulsion. Specific examples thereof include styrene-butadiene rubber latex, acrylonitrile-butadiene latex, methyl acrylate-butadiene latex, and vinyl acetate emulsion.

To the undercoat layer may be added a wax, an anti-discoloration agent, a surfactant or the like.

The content of the binder is preferably from 3 to 100% by mass of the pigment added to the undercoat layer, more preferably from 5 to 50% by mass thereof, and most preferably from 8 to 15% by mass thereof.

The undercoat layer may be formed by a known coating method. Examples thereof include coating methods using an air knife coater, a roll coater, a blade coater, a gravure coater, and a curtain coater. Particularly preferred is the method using a blade coater.

If necessary, the undercoat layer may be subjected to smoothening treatment such as calendar treatment.

Protective Layer

If necessary, a protective layer may be formed on the heat-sensitive color developing layer. The protective layer comprises organic or inorganic fine particles, a binder, a surfactant, a heat-meltable substance or the like.

Examples of the fine particles include inorganic fine particles made of calcium carbonate, silica, zinc oxide, titanium oxide, aluminum hydroxide, zinc hydroxide, barium sulfate, clay, talc, and surface-treated calcium or silica; and organic fine particles made of urea-formalin resin, styrene/methacrylic acid copolymer, and polystyrene.

Examples of the binder in the protective layer include polyvinyl alcohol, carboxy-modified polyvinyl alcohol, vinyl acetate-acrylamide copolymer, silicon-modified polyvinyl alcohol, starch, modified-starch, methylcellulose, carboxymethylcellulose, hydroxymethylcellulose, gelatins, gum arabic, casein, hydrolyzates of styrene-maleic acid copolymer, polyacrylamide derivatives, polyvinyl pyrrolidone, and latexes such as styrene-butadiene rubber latex, acrylonitrile-butadiene rubber latex, methyl acrylate-butadiene rubber latex, and vinyl acetate emulsion.

In order to crosslink the binder and improve the storage stability of the heat-sensitive recording material still more, a waterproofing agent may be added thereto. Examples of the waterproofing agent include water-soluble initial condensates such as N-methylolurea, N-methylolmelamine and urea-formalin; dialdehyde compounds such as glyoxal and glutar aldehyde; inorganic crosslinking agents such as boric acid and borax and colloidal silica; and polyamideepichlorohydrin.

EXAMPLES

The present invention will be described by way of the following examples. However, the invention is not limited to these examples. The word "part(s)" and the symbol "%" in the examples represent "part(s) by mass" and "% by mass", respectively. The volume-average particle size of particles is measured with a laser diffraction type particle distribution measuring apparatus LA500 (manufactured by Horiba Ltd.).

Example 1

Formation of a Heat-Sensitive Recording Material

Preparation of a Heat-Sensitive Color Developing Layer Coating Solution

Preparation of a Dispersed Solution A

The following components are dispersed by a sand grinder to yield a dispersed solution A having a volume-average particle size of 0.8 $\mu$m.

| [Composition of the dispersed solution A] | |
|---|---|
| 3-dibutylamino-6-methyl-7-anilinofluorane (electron-donating colorless dye) | 10 parts |
| 10% aqueous solution of polyvinyl alcohol (PVA-105, made by Kuraray Co., Ltd.) | 15 parts |
| water | 25 parts |

Preparation of a Dispersed Solution B

The following components are dispersed by a sand grinder to yield a dispersed solution B having a volume-average particle size of 0.8 $\mu$m.

| [Composition of the dispersed solution B] | |
|---|---|
| 2,4-bis(phenylsulfonyl)phenol (electron-accepting compound) | 20 parts |
| 2-naphthyl benzyl ether | 20 parts |
| 10% aqueous solution of sulfonic acid-modified polyvinyl alcohol (GOHSERAN L3266, made by the Nippon Synthetic Chemical Industry Co., Ltd.) | 60 parts |
| water | 100 parts |

Preparation of a Dispersed Solution C

The following components are dispersed by a sand mill to yield a dispersed solution C having a volume-average particle size of 1.5 $\mu$m.

| [Composition of the dispersed solution C] | |
|---|---|
| light calcium carbonate | 25 parts |
| 40% aqueous solution of sodium polyacrylate | 0.25 part |
| sodium hexametaphosphoric acid | 0.25 part |
| water | 34 parts |

Preparation of a Heat-Sensitive Color Developing Layer Coating Solution

The components of the following composition are mixed to yield a coating solution for a heat-sensitive color developing layer.

| [Composition of the heat-sensitive color developing layer coating solution] | |
|---|---|
| the above-mentioned dispersed solution A | 50 parts |
| the above-mentioned dispersed solution B | 200 parts |
| the above-mentioned dispersed solution C | 60 parts |
| 30% dispersed solution of zinc stearate | 10 parts |
| 30% dispersed solution of paraffin wax | 20 parts |
| 20% dispersed solution of stearic acid amide | 2 parts |
| 50% aqueous solution of a brightening agent | 1 part |
| 10% aqueous solution of acetoacetyl-modified polyvinyl alcohol (GOHSEFIMER Z210, made by the Nippon Synthetic Chemical Industry Co., Ltd.) | 40 parts |
| 10% aqueous solution of glyoxal | 5 parts |

Formation of a Heat-Sensitive Recording Material

An undercoat layer containing mainly a pigment and a binder is applied with a blade coater onto a base sheet having a weight of 70 g/m$^2$, so as to form an undercoated base sheet. The coating amount thereof is 10 g/m$^2$ after being dried. Next, the heat-sensitive color developing layer coating solution prepared in the above manner is applied onto the undercoat layer of the base sheet with a curtain coater and then the resultant layer is dried. The coating amount thereof is 4 g/m$^2$ after being dried. The surface of the formed heat-sensitive color developing layer is subjected to calendar treatment to yield a heat-sensitive recording material of the invention.

Example 2

A heat-sensitive recording material of the invention is formed in the same manner as in Example 1 except for three modifications. The first modification is that the amount of the 10% aqueous solution of sulfonic acid-modified polyvinyl alcohol is changed from 60 parts to 50 parts in the <<Preparation of a dispersed solution B>> in Example 1. The second modification is that 50 parts of a 10% aqueous solution of acetoacetyl-modified polyvinyl alcohol (GOHSEFIMER Z210, made by The Nippon Synthetic Chemical Industry Co., Ltd.) are used in the <<Preparation of a dispersed solution B>> in Example 1. The third modification is that 40 parts of a 10% aqueous solution of polyvinyl alcohol (PVA-17, made by Kuraray Co., Ltd.) are used instead of the 10% aqueous solution of acetoacetyl-modified polyvinyl alcohol in the <<Preparation of a heat-sensitive color developing layer coating solution>> in Example 1.

Example 3

A heat-sensitive recording material of the invention is formed in the same manner as in Example 1 except in that 40 parts of a 10% aqueous solution of diacetone-modified polyvinyl alcohol (D polymer, made by Unichika, Ltd.) are used instead of the 10% aqueous solution of acetoacetyl-modified polyvinyl alcohol in the <<Preparation of a heat-sensitive color developing layer coating solution>> in Example 1.

Example 4

A heat-sensitive recording material of the invention is formed in the same manner as in Example 1 except in that a 30% dispersed solution of calcium stearate is used instead of the 30% dispersed solution of zinc stearate in the <<Preparation of a heat-sensitive color developing layer coating solution>> in Example 1.

Example 5

A heat-sensitive recording material of the invention is formed in the same manner as in Example 1 except in that a 30% dispersed solution of ethylenebisstearic acid amide (melting point: 145° C.) is used instead of the 30% dispersed solution of zinc stearate in the <<Preparation of a heat-sensitive color developing layer coating solution>> in Example 1.

Example 6

A heat-sensitive recording material of the invention is formed in the same manner as in Example 1 except in that a 30% dispersed solution of N-stearyl-N'-stearylurea (melting point: 109° C.) is used instead of the 30% dispersed solution of zinc stearate in the <<Preparation of a heat-sensitive color developing layer coating solution>> in Example 1.

Example 7

A heat-sensitive recording material of the invention is formed in the same manner as in Example 1 except in that a 30% dispersed solution of paraffin wax (melting point: 135° C.) is used instead of the 30% dispersed solution of zinc stearate in the <<Preparation of a heat-sensitive color developing layer coating solution>> in Example 1.

Example 8

A heat-sensitive recording material of the invention is formed in the same manner as in Example 1 except for two modifications. The first modification is that the 10% aqueous solution of glyoxal and the 30% dispersed solution of zinc stearate are not used in the <<Preparation of a heat-sensitive color developing layer coating solution>> in Example 1. The second modification is that a protective layer coating solution is applied onto the heat-sensitive color developing layer, the applied layer is dried, and the surface of the formed protective layer is subjected to calendar treatment. The protective layer coating solution is applied in amount of 1.0 g/m$^2$ after being dried.

Preparation of a Protective Layer Coating Solution

The components of the following composition are mixed to yield a coating solution for a protective layer.

| [Composition of the protective layer coating solution] | |
|---|---|
| 10% aqueous solution of polyvinyl alcohol (PVA-117, made by Kuraray Co., Ltd.) | 40 parts |
| 10% aqueous solution of glyoxal | 5 parts |
| 30% dispersed solution of zinc stearate | 10 parts |
| water | 45 parts |

Comparative Example 1

A heat-sensitive recording material for comparison is prepared in the same manner as in Example 1 except in that bisphenol A is used instead of 2,4-bis(phenylsulfonyl)phenol in the <<Preparation of a dispersed solution B>> in Example 1.

Comparative Example 2

A heat-sensitive recording material for comparison is prepared in the same manner as in Example 1 except in that 40 parts of a 10% aqueous solution of polyvinyl alcohol (PVA-117, made by Kuraray Co., Ltd.) are used instead of the 10% aqueous solution of acetoacetyl-modified polyvinyl alcohol in the <<Preparation of a heat-sensitive color developing layer coating solution>> in Example 1.

Comparative Example 3

A heat-sensitive recording material for comparison is prepared in the same manner as in Example 1 except in that no zinc stearate is used in the <<Preparation of a heat-sensitive color developing layer coating solution>> in Example 1.

Evaluation

About the heat-sensitive recording materials of Examples 1 to 8 and the heat-sensitive recording materials of Comparative Examples 1 to 3 prepared as above, the color development density, storage stability (heat resistance, humidity resistance and plasticizer resistance), water resistance, stamping property and sticking resistance thereof are evaluated as follows. The measured results and evaluated results are shown in Table 1.

(1) Print Density

A heat-sensitive printer having a thermal head (KJT-216-8MPD1) made by Kyocera Corp. and a pressure roll positioned just before the head and giving a pressure of 100 kg/cm$^2$ is used. While the pressure roll is used under the following conditions: a head voltage of 24 V and a pulse cycle of 10 ms, printing is carried out at a pulse width of 2.1 ms. The print density of printed portions is measured with a Macbeth reflection density meter (RD-918 made by Macbeth Co.). In accordance with the following criteria, the heat-sensitive recording materials are evaluated.

Evaluating Criteria

◎: The print density is 1.35 or more, and the result is very good.

○: The print density is 1.30 or more and less than 1.35, and the result is good.

X: The print density is less than 1.30, and the result is insufficient.

Furthermore, the density of the non-printed portion (background portion) in each of the heat-sensitive recording materials is measured as the density of the non-image portion (background fog) with the Macbeth reflection density meter (RD-918 made by Macbeth Co.). In accordance with the following criteria, the heat-sensitive recording material is evaluated.

Evaluating Criteria

◎: The background fog is less than 0.10, and the result is very good.

○: The background fog is 0.10 or more and less than 0.15, and the result is good.

X: The background fog is 0.15 or more, and the result is insufficient.

(2) Storage Stability

Heat Resistance

Each of the printed heat-sensitive recording materials is stored in an environment having a temperature of 60° C. and a relative humidity of 30% for 24 hours, and the print density of the printed portion and the density of the background portion are measured with the Macbeth reflection density meter RD-918. The results are used as indices for representing the heat resistance. The indices are evaluated in accordance with the evaluating criteria described in the item "(1) Print density". Larger value of the density of printed portions means larger density after the heat resistance test and a better result. Smaller value of the density of background portions means smaller fog after the heat resistance test and a better result.

Humidity Resistance

Each of the printed heat-sensitive recording materials is stored in an environment having a temperature of 40° C. and a relative humidity of 90% for 24 hours, and the print density of the printed portion and the density of the background are measured with the Macbeth reflection density meter RD-918. The results are used as indices for representing the humidity resistance. The indices are evaluated in accordance with the evaluating criteria described in the item "(1) Print density". Larger value of the density of printed portions and smaller value of the density of background portions mean better evaluation results as the same as in the above-mentioned evaluation.

Plasticizer Resistance

Each of the printed heat-sensitive recording materials is stored in an environment having a temperature of 25° C. for 24 hours in the state that the material contacted a commercially available polyvinyl chloride sheet (Polyma Wrap, made by Shin-Etsu Polymer Co., Ltd.). Thereafter, the print density of the printed portion and the density of the background portion are measured with the Macbeth reflection density meter RD-918. The results are used as indices for representing the plasticizer resistance. The indices are evaluated in accordance with the following evaluating criteria. Larger value of the density of printed portions and smaller value of the density of background portions mean smaller variation in the density and a better result as the same as in the above-mentioned evaluation.

Evaluating Criteria

◎: The remaining rate of printed portions is 95% or more, and the result is very good.
○: The remaining rate of printed portions is 90% or more and less than 95%, and the result is good.
X: The remaining rate of printed portions is less than 90%, and the result is insufficient.

(3) Water Resistance

Each of the heat-sensitive recording materials printed in the same manner as in the (1) is immersed in water having a temperature of 20° C. for 5 minutes, and then the printed portion is rubbed 10 times with a finger. Thereafter, the printed portion is observed with the naked eye, and the water resistance of the heat-sensitive recording material is evaluated in accordance with the following criteria.

Evaluating Criteria

○: The printed portion is not peeled at all.
Δ: The printed portion is slightly peeled.
X: Almost all of the printed portion is peeled.

(4) Stamping Property

Each of the heat-sensitive recording materials is stamped with a red stamp requiring no stamp pad (trade name: Shachihata stamp, made by Shachihata Inc.). After one minute, a piece of high quality paper is put on the stamped portion. The state that the ink is transferred is observed with the naked eye. In accordance with the following criteria, the level that the ink is dried (the stamping property) is evaluated.

Evaluating Criteria

◎: No ink adhered to the high quality paper.
○: The ink adhered slightly to the high quality paper, but no problem is brought into practical use.
Δ: The ink adhered to the high quality paper, and stains are noticeable.
X: A large amount of the ink adhered to the high quality paper. Even when the same test is made after fine minutes, the ink adhered to the high quality paper.

(5) Sticking Resistance

A heat-sensitive printer having a thermal head (KF2003-GD31A, Rohm Co., Ltd.) having a partial glace structure is used to perform printing under the following conditions: a head voltage of 24 V, a printing cycle of 0.98 ms/line (printing speed: 12.8 cm/second), and a pulse width of 0.375 ms (applied energy: 14.4 mJ/mm$^2$). Printing sounds and the state of white spots of the printed portion, the white spots being observed with the naked eye, are evaluated in accordance with the following criteria.

Evaluating Criteria

○: No noises except printing sounds are generated, and no white spot is observed in the printed portion.
Δ: A few noises are generated, and a few white spots are observed in the printed portion.
X: Noises (adhesion sound) are evidently generated, and many white spots are observed in the printed portion.

TABLE 1

| | | | | | Heat resistance | | | |
|---|---|---|---|---|---|---|---|---|
| | Print density | Evaluation | Background density | Evaluation | Printed portion | Evaluation | Background portion | Evaluation |
| Example 1 | 1.31 | ○ | 0.06 | ◎ | 1.30 | ○ | 0.12 | ○ |
| Example 2 | 1.32 | ○ | 0.06 | ◎ | 1.31 | ○ | 0.12 | ○ |
| Example 3 | 1.32 | ○ | 0.06 | ◎ | 1.31 | ○ | 0.12 | ○ |
| Example 4 | 1.31 | ○ | 0.06 | ◎ | 1.30 | ○ | 0.11 | ○ |
| Example 5 | 1.30 | ○ | 0.06 | ◎ | 1.30 | ○ | 0.11 | ○ |
| Example 6 | 1.33 | ○ | 0.07 | ◎ | 1.32 | ○ | 0.13 | ○ |
| Example 7 | 1.30 | ○ | 0.06 | ◎ | 1.30 | ○ | 0.11 | ○ |
| Example 8 | 1.30 | ○ | 0.05 | ◎ | 1.30 | ○ | 0.10 | ○ |
| Comparative Example 1 | 1.34 | ○ | 0.06 | ◎ | 0.68 | X | 0.08 | ◎ |
| Comparative Example 2 | 1.31 | ○ | 0.07 | ◎ | 1.30 | ○ | 0.12 | ○ |

TABLE 1-continued

| | | | | | | | | |
|---|---|---|---|---|---|---|---|---|
| Comparative Example 3 | 1.31 | ○ | 0.05 | ◎ | 1.31 | ○ | 0.10 | ○ |

| | Humidity resistance | | | | Plasticizer resistance | | | | |
|---|---|---|---|---|---|---|---|---|---|
| | Printed portion | Evaluation | Background portion | Evaluation | Printed portion remaining rate | Evaluation | Water resistance | Stamping property | Sticking resistance |
| Example 1 | 1.30 | ○ | 0.06 | ◎ | 95% | ◎ | ○ | ○ | ○ |
| Example 2 | 1.31 | ○ | 0.06 | ◎ | 95% | ◎ | ○ | ○ | ○ |
| Example 3 | 1.31 | ○ | 0.06 | ◎ | 96% | ◎ | ○ | ○ | ○ |
| Example 4 | 1.29 | ○ | 0.06 | ◎ | 95% | ◎ | ○ | ○ | Δ |
| Example 5 | 1.29 | ○ | 0.06 | ◎ | 95% | ◎ | ○ | ○ | ○ |
| Example 6 | 1.31 | ○ | 0.07 | ◎ | 95% | ◎ | ○ | ○ | Δ |
| Example 7 | 1.29 | ○ | 0.06 | ◎ | 96% | ◎ | ○ | ○ | Δ |
| Example 8 | 1.30 | ○ | 0.06 | ◎ | 97% | ◎ | ○ | Δ | ○ |
| Comparative Example 1 | 1.30 | ○ | 0.06 | ◎ | 15% | X | ○ | ○ | ○ |
| Comparative Example 2 | 1.30 | ○ | 0.07 | ◎ | 95% | ◎ | X | ○ | ○ |
| Comparative Example 3 | 1.31 | ○ | 0.05 | ◎ | 95% | ◎ | ○ | ○ | X |

As evident in Table 1, the heat-sensitive recording materials of Examples 1 to 8 show high color development density and excellent results in the every evaluation such as the storage stability (heat resistance, humidity resistance and plasticizer resistance (solvent resistance)) and water resistance in the printed portions and the non-image portions (background portions). In Example 8, in which the protective layer is disposed on the heat-sensitive color developing layer, the adhesion of the ink is observed, but the heat-sensitive recording materials of Examples 1 to 7 are very good in stamping property. Furthermore, the heat-sensitive recording materials of Examples 1 to 3, 5 and 8, in which the aliphatic acid metal salt or the aliphatic acid amide compound having a melting point of 105° C. or more is used as the lubricant contained in the outermost layer, had, in particular, excellent sticking resistance.

On the other hand, the heat-sensitive recording material of Comparative Example 1, in which bisphenol A is used as an electron-accepting compound instead of 2,4-bis(phenylsulfonyl)phenol, clearly had a low heat resistance and a low plasticizer resistance in the printed portion, and is not practical in these points. The heat-sensitive recording material of Comparative Example 2, in which polyvinyl alcohol is used instead of acetoacetyl-modified polyvinyl alcohol contained in the heat-sensitive color developing layer, had a low water resistance and is not practical. The heat-sensitive recording material of Comparative Example 3, which contained no lubricant in its outermost layer, is poor in sticking resistance. Moreover, noises are generated at the time of the recording, and many white spots are observed in the image portion.

According to the present invention, it is possible to provide a heat-sensitive recording material which has a high sensitivity, gives a high print density, is superior in storage stability (heat resistance, humidity resistance and plasticizer resistance (solvent resistance)) of imager portions and non-image portions (background portions) and head break resistance, and is particularly superior in water resistance, stamping property and sticking resistance.

What is claimed is:

1. A heat-sensitive recording material which comprises, on a substrate, at least one heat-sensitive color developing layer comprising an electron-donating colorless dye, 2,4-bis(phenylsulfonyl)phenol as an electron-accepting compound, and a sulfonic acid-modified polyvinyl alcohol and at least one modified polyvinyl alcohol other than the sulfonic acid-modified polyvinyl alcohol as binders, an outermost layer of the heat-sensitive recording material comprising a lubricant.

2. A heat-sensitive recording material according to claim 1, wherein the 2,4-bis(phenylsulfonyl)phenol is dispersed and contained in the binders comprising the sulfonic acid-modified polyvinyl alcohol and the other modified polyvinyl alcohol(s), so as to have a volume-average particle size of 0.4 to 1.0 $\mu$m.

3. A heat-sensitive recording material according to claim 1, wherein the 2,4-bis(phenylsulfonyl)phenol is dispersed and contained in the binders comprising the sulfonic acid-modified polyvinyl alcohol and the other modified polyvinyl alcohol(s), so as to have a volume-average particle size of 0.4 to 0.8 $\mu$m.

4. A heat-sensitive recording material according to claim 1, wherein the heat-sensitive color developing layer further comprises, as an electron-accepting compound, one selected from the group consisting of phenolic compounds, salicylic acid derivatives, and polyvalent metal salts thereof, in addition to the 2,4-bis(phenylsulfonyl)phenol.

5. A heat-sensitive recording material according to claim 1, wherein the heat-sensitive color developing layer further comprises, as an electron-accepting compound, 2,4-bis(2,5-dimethylphenylsulfonyl)phenol, in addition to the 2,4-bis(phenylsulfonyl)phenol.

6. A heat-sensitive recording material according to claim 1, wherein the heat-sensitive color developing layer comprises the electron-accepting compound in an amount of 50 to 500% by mass based on an amount of the electron-donating colorless dye.

7. A heat-sensitive recording material according to claim 1, wherein the heat-sensitive color developing layer comprises the electron-accepting compound in an amount of 100 to 300% by mass based on an amount of the electron-donating colorless dye.

8. A heat-sensitive recording material according to claim 1, wherein the electron-donating colorless dye is at least one selected from 3-di(n-butylamino)-6-methyl-7-anilinofluorane and 2-anilino-3-methyl-6-N-ethyl-N-sec-butylaminofluorane.

9. A heat-sensitive recording material according to claim 1, wherein the electron-donating colorless dye is contained, as a solid dispersion dispersed in a solvent, in a coating solution for forming the heat-sensitive color developing layer.

10. A heat-sensitive recording material according to claim 1, wherein the electron-donating colorless dye is contained in a coating solution for forming the heat-sensitive color developing layer, encapsulated in microcapsules.

11. A heat-sensitive recording material according to claim 1, wherein a content of the electron-donating colorless dye in the heat-sensitive color developing layer is from 0.1 to 1.0 $g/m^2$.

12. A heat-sensitive recording material according to claim 1, wherein a content of the electron-donating colorless dye in the heat-sensitive color developing layer is from 0.2 to 0.5 $g/m^2$.

13. A heat-sensitive recording material according to claim 1, wherein the lubricant is at least one selected from aliphatic acid metal salts, and aliphatic acid amide compounds having a melting point of 105° C. or more.

14. A heat-sensitive recording material according to claim 1, wherein the heat-sensitive color developing layer comprises an acetoacetyl-modified polyvinyl alcohol as the modified polyvinyl alcohol other than the sulfonic acid-modified polyvinyl alcohol.

15. A heat-sensitive recording material according to claim 14, wherein the lubricant is at least one selected from aliphatic acid metal salts, and aliphatic acid amide compounds having a melting point of 105° C. or more.

16. A heat-sensitive recording material according to claim 1, wherein the heat-sensitive color developing layer comprises the sulfonic acid-modified polyvinyl alcohol in an amount of 30 to 90 parts by mass per 100 parts by mass of the at least one modified polyvinyl alcohol other than the sulfonic acid-modified polyvinyl alcohol.

17. A heat-sensitive recording material according to claim 1, wherein a coating amount of the binders comprising the sulfonic acid-modified polyvinyl alcohol and the at least one modified polyvinyl alcohol other than the sulfonic acid-modified polyvinyl alcohol is from 0.01 to 5 $g/m^2$ in the heat-sensitive color developing layer.

18. A heat-sensitive recording material according to claim 1, wherein the heat-sensitive color developing layer further comprises at least one of 2-naphthyl benzyl ether and amide compounds as a heat-meltable substance or heat-meltable substances.

19. A heat-sensitive recording material according to claim 1, wherein the heat-sensitive color developing layer further comprises an image stabilizer in an amount of 30 to 60 parts by mass per 100 parts by mass of the electron-donating colorless dye.

20. A heat-sensitive recording material according to claim 1, further comprising, on the substrate, an undercoat layer including a pigment as a main component thereof.

* * * * *